US005398867A

United States Patent [19]

Murphy

[11] Patent Number: 5,398,867

[45] Date of Patent: Mar. 21, 1995

[54] COMBINATION PAPER AND ENVELOPES FORMED ON A CONTINUOUS PAPER WEB

[76] Inventor: Kathleen M. Murphy, 8041 Southgate Blvd., Apt. #12, North Lauderdale, Fla. 33068

[21] Appl. No.: 155,674

[22] Filed: Nov. 22, 1993

Related U.S. Application Data

[63] Continuation of Ser. No. 982,435, Nov. 27, 1992, abandoned.

[51] Int. Cl.[6] ..... B65D 27/10

[52] U.S. Cl. ..... 229/69; 229/92.1

[58] Field of Search ..... 229/69, 92.1, 92, 314, 229/316

[56] References Cited

U.S. PATENT DOCUMENTS

| | | | |
|---|---|---|---|
| 1,801,155 | 4/1931 | Harson | 229/92.1 |
| 2,257,766 | 4/1936 | Sherman . | |
| 3,217,972 | 11/1965 | McNelis | 229/92.1 |
| 3,228,586 | 1/1966 | Hayes, Jr. | 229/92.1 X |
| 3,557,519 | 1/1971 | Lyon, Jr. | 229/92.1 X |
| 3,941,309 | 3/1976 | Gendron . | |
| 3,955,750 | 5/1976 | Huffman | 229/92.1 X |
| 3,977,597 | 8/1976 | Wise et al. | 229/92.1 X |
| 3,998,138 | 12/1976 | Walters | 229/92.1 X |
| 4,063,398 | 12/1977 | Huffman . | |
| 4,067,171 | 1/1978 | Herbert et al. . | |
| 4,199,630 | 4/1980 | Consiglio | 229/69 X |
| 4,625,909 | 12/1986 | Ferranado . | |
| 4,630,768 | 12/1986 | Bradley | 229/92.1 X |
| 4,860,946 | 8/1989 | Braud . | |
| 4,896,823 | 1/1990 | Taylor | 229/69 X |
| 4,912,909 | 4/1990 | Stenner . | |
| 5,052,977 | 10/1991 | Irvine . | |
| 5,076,489 | 12/1991 | Steidlinger . | |

*Primary Examiner*—Allan N. Shoap
*Assistant Examiner*—Jes F. Pascua
*Attorney, Agent, or Firm*—Oltman and Flynn

[57] ABSTRACT

According to the invention, there is provided a continuous envelope and letter arrangement for printing letters and envelope address information on a continuous paper web having a forward side for receiving printing and a back side, lateral edge strips with sprocket holes on the paper web, alternating envelope and letter panels disposed along the paper web, and tear-off lines disposed transversely between the edge strips for separating the envelope and letter panels, and adhesive means on the envelope panels for sealing the envelopes. According to a further feature, the continuous envelope and letter arrangement includes lateral tear-off lines on the paper web for separating the edge strips from the paper web, and further, a center crease line on the envelope panel, disposed transversely between the edge strips for dividing the envelope panels into two substantially equal size half panels, the half panels respectively forming a front and a back side of the envelope.

5 Claims, 3 Drawing Sheets

COMBINATION PAPER AND ENVELOPES FORMED ON A CONTINUOUS PAPER WEB

This application is a continuation of application Ser. No. 07/982,435, filed Nov. 27, 1992, now abandoned.

The invention relates to an arrangement of envelopes and letters prepared on a continuous sprocket fed single paper web, and in particular an arrangement to be printed in a sprocket feeding printer connected to a computer for printing letter information on letter panels and address information on adjoining envelope panels, and wherein tear lines are provided for separating envelopes and letters.

BACKGROUND AND PRIOR ART

Since the advent of the small computer with associated printers which have become widespread in recent years, considerable attention and efforts have been directed to methods and systems for simplifying the process of preparing large numbers of letters and envelopes and reducing the amount of labor involved in the process.

Several inventors have shown methods of preparing form letters on computers and preparing at the same time envelopes with the address information relating to respective letters.

U.S. Pat. No. 4,625,909, as an example, shows a computerized correspondence form wherein several layers, i.e. plies of sprocket-fed paper are processed through a printer and wherein various layers provide adhesive, carbon copying, and other features to produce a complete mailing system.

U.S. Pat. No. 4,063,398 shows another multi-ply letter and envelope printing arrangement based on sprocket-fed paper material.

Still other arrangements are shown in the prior art for preparing printed envelopes and letters in one continuous process.

All the arrangements of the known art, however, suffer from the drawback that complex multi-ply sprocket-fed paper material must be used. Such material is not only expensive, but requires printers capable of printing through several plies of material, and do not lend themselves for use in smaller offices and establishments where specialized printing equipment and paper handling machinery is not readily available.

It is accordingly an object of the invention to provide an arrangement that makes it possible to prepare letters and envelopes from single ply paper stock that can be handled in computers and printers as are commonly used in offices wherein large specially adapted machines are not readily available.

SUMMARY OF THE INVENTION

The invention accordingly provides a system based on a continuous single ply paper web with sprocket holes to be fed through a computer printer. The web is divided by transverse tear-off lines in letter and envelope panels, the latter having gum lines for sealing the envelopes. Crease lines may also be preformed in the various letter and envelope panels to facilitate folding of the various parts of the system. The system has the further advantage that corresponding letters and envelopes are processed together, so that mix-up of unmatched letters and envelopes is easily avoided.

The invention has the further advantage that printing can be made with laser printing, since all printing is performed on the same forward facing surface of the paper web. Laser printing provides superior letter quality, not attainable with matrix printers and type printers.

According to the invention, there is provided a continuous envelope and letter arrangement for printing letters and envelope address information on a continuous paper web having a forward side for receiving printing and a back side, lateral edge strips with sprocket holes on the paper web, alternating envelope and letter panels disposed along the paper web, and tear-off lines disposed transversely between the edge strips for separating the envelope and letter panels, and adhesive means on the envelope panels for sealing the envelopes.

According to a further feature, the continuous envelope and letter arrangement includes lateral tear-off lines on the paper web for separating the edge strips from the paper web, and further, a center crease line on the envelope panel, disposed transversely between the edge strips for dividing the envelope panels into two substantially equal size half panels, the half panels respectively forming a front and a back side of the envelope.

According to still another feature, the continuous envelope and letter arrangement includes on one of the envelope half panels a gummed flap extending away from the respective half panels, for sealing the envelope, and a crease line dividing the gummed flap and the respective half panel to facilitate folding the gummed flap over backwards to engage the respective opposite half panel, and wherein the gum flap has gum on the front side of the web.

The continuous envelope and letter arrangement may further include a backward facing gum line on the backside of the paper web, the backward facing gum lines extending along one transverse edge away from the center crease line of one of the half panels and along its two lateral side edges for sealing the envelope panel.

The continuous envelope and letter arrangement may advantageously be arranged such that the letter panels have a length L1 taken in direction of the paper web, and the envelope panels have a width We taken transversely to the paper web between the gum lines extending along the lateral side edges, and wherein the width We is greater than the length L1, and wherein the letter panels have a width W1 taken between the side strips, and the envelope panels have a length Le taken in direction of the paper web, such that the width of the letter panels is less than the length of the envelope panels.

The invention may further include a continuous envelope and letter arrangement including multiple page panels in each of the letter panels by means of further transverse tear-off lines separating the multiple page panels.

The adhesive means for sealing the envelopes may include heat sensitive adhesive strips.

The invention may also include an arrangement wherein each of the envelope panels is formed as a completed envelope composed of a forward facing envelope panel, and a backward facing back panel attached along three edges to the forward facing envelope panel, or wherein the continuous envelope and letter arrangement includes alternating groups of letter panels and completed envelopes, wherein for example the continuous envelope and letter arrangement includes a gummed flap connected with one of the envelope panels along a fourth edge of the panel.

The invention may additionally include an envelope and letter arrangement comprising a paper web of a given length, the paper web divided by tear-off lines transverse to the paper web into at least one letter panel and at least one envelope with four edges, the envelope including a front panel, a back panel, three of the four edges being sealed edges connecting the front and back panel, and a gummed flap connected to a fourth edge for finally sealing the envelope.

Further objects and advantages of this invention will be apparent from the following detailed description of a presently preferred embodiment which is illustrated schematically in the accompanying drawings.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DESCRIPTION OF THE PREFERRED EMBODIMENTS

Figure 1:
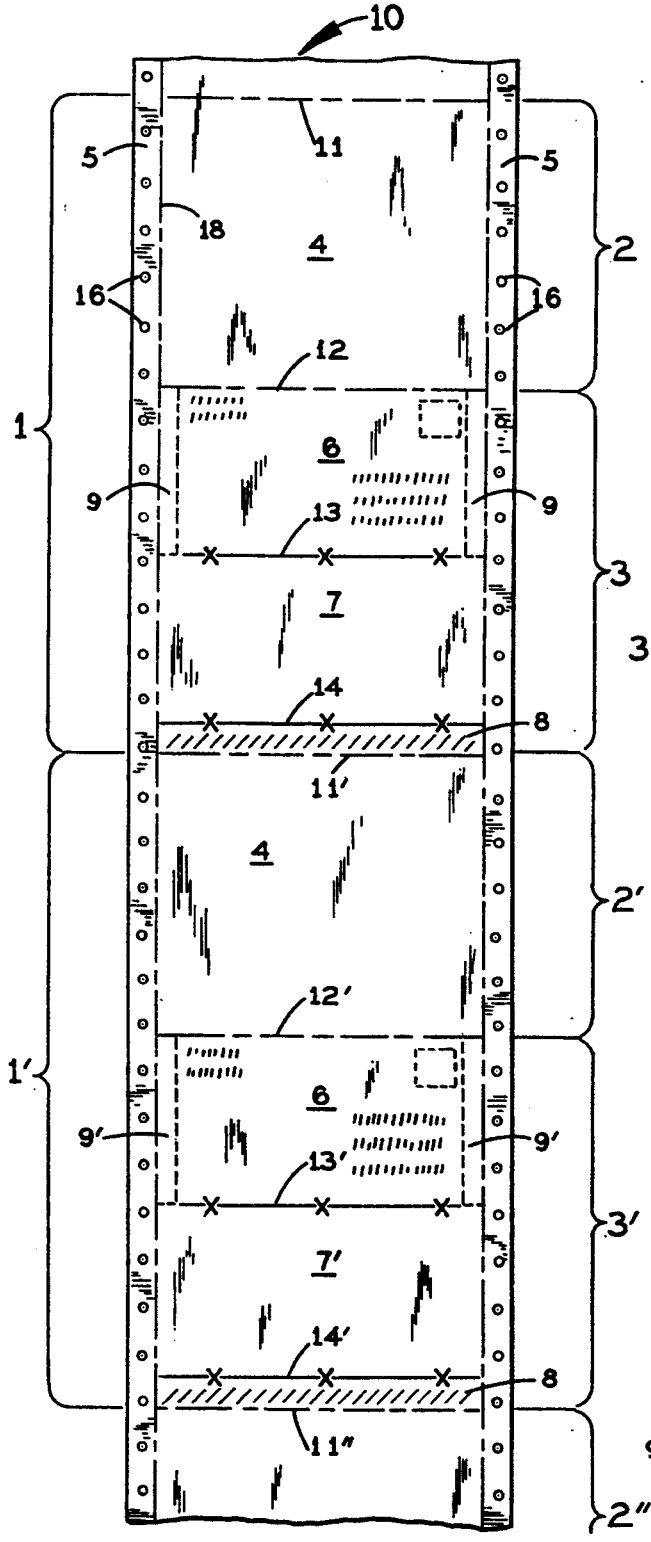
FIG. 1 is a plan view of the invention showing a continuous paper web for sprocket feeding, divided into letter and envelope panels.

FIG. 1 shows a continuous paper web 10 having two lateral side strips 5 with sprocket holes 16 for feeding the paper web through a sprocket feeding computer printer. The lateral side strips are connected to the paper web by tear-off lines 18, 19 as is well known in sprocket fed paper webs. In the figures the tear-off lines are shown as stippled lines such as lines 18, 19. The paper web between the lateral strips is divided into alternating letter panels 2 and envelope panels 3, wherein the envelope panels are divided along a crease line 13 about which the envelope panel 3 can be folded into half panels 6 and 7, joined by the crease line 13 shown as a line interrupted by x's. Half panel 6 is the front half panel arranged to receive address information and postage, and half panel 7 is the rear half panel.

The paper web 10 has a forward side facing the viewer on which all printing is performed and a back side, not shown.

The letter panel 2 and the envelope panel 3 are joined by a tear-off line 12. The lower envelope half panel 7 extends downward into a gummed flap 8 joined to the lower half panel 7 by another crease line 14, and is joined downward via a tear-off line 11' by a next set of a letter panel 2' and an envelope panel 3', again joined by a tear-off line 12', and connected to still another letter panel 2'' via another gum strip 8' and a tear line 11''. It follows that the paper web can be as long as desired, and can be taken off a roll, or from a stack of fan-fold paper wherein the folds are separated by the tear-lines 11, 12, 14.

The forward side of the paper web 10, facing the viewer, is fed through the printer with the forward side facing the print head, which is controlled by a computer to print all letter information in the letter panels 2, and all address information in the upper forward half panels 6 of the envelope panels 7. It follows that various information can also be printed on the lower envelope half, if desired, by programming the printhead to write the characters upside-down as can be done with some printers.

Figure 7:
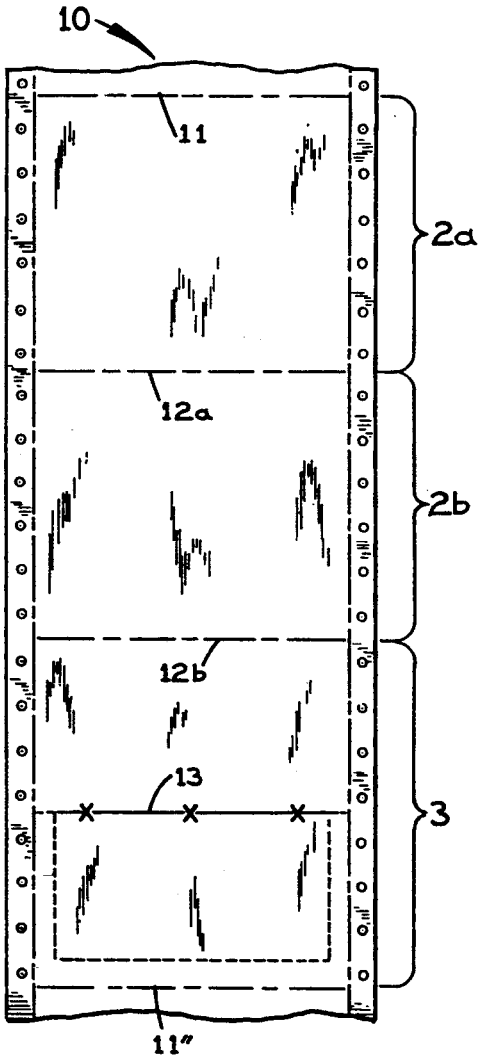
FIG. 7 is a plan view of the invention showing the continuous paper web arranged to have a tear-off duplicate letter panel.

It also follows that the paper web may be arranged to have two or more letter panels shown as 2*a* and 2*b* if letters with more than one page are required, or if a duplicate letter is desired for an office file or a receiver return copy (FIG. 7).

The gummed flap 8 has an adhesive applied to the forward side of the paper web. The adhesive may be of the conventional type that is activated by moistening the adhesive before sealing, or it can be one of the well-known melt type adhesives that is activated by heating the adhesive.

Figure 2:
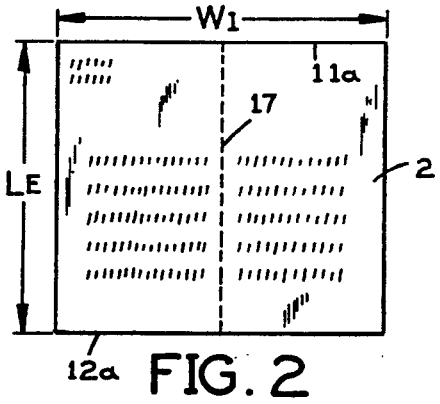
FIG. 2 is a plan detail view showing a separate letter panel.

FIG. 2 shows a separate letter panel 2 after it has been separated from the web along a tear-line 11' or 11'' at the upper edge 11*a* of the letter panel 2 and along the lower tear-line 12, forming the lower edge 12*a* of the letter panel 2.

Figure 3:
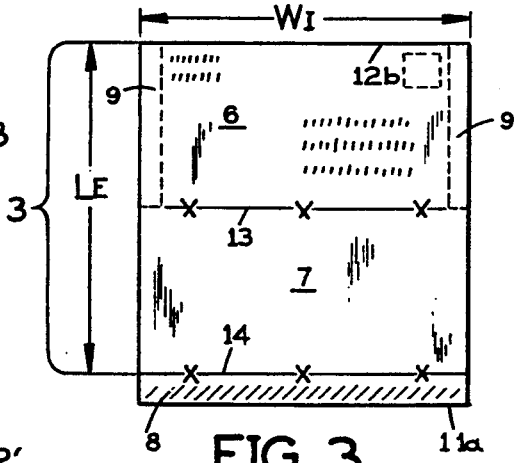
FIG. 3 is a plan view showing an envelope panel.

FIG. 3 shows an envelope panel 3 divided into two half panels 6 and 7, the latter half panel 7 extending via crease line 14 into the gummed flap 8, with a lower tear-off edge 11'*a*.

In order to seal the envelope'at the sides of the envelope, two side gum lines 9 may be provided, which are applied to the back side of the paper web at the time the web is prepared.

Figure 4A:
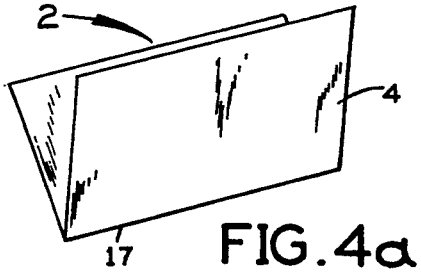
FIG. 4*a* is a perspective view showing a folded letter panel.
Figure 4B:
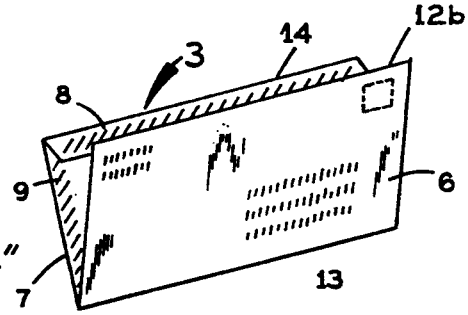
FIG. 4*b* is a perspective view showing a folded envelope panel before sealing.

FIGS. 4*a* and *b* show an envelope panel 3 being folded about a center crease line 13 with the forward facing envelope half panel 6 with address information printed thereon. The gummed flap 8 has been folded inward, and the letter panel 4 has been folded about a center crease line 17 so that it fits into the envelope. After insertion the gum flap 8 and the gum strips 9 are moistened and the envelope is sealed and ready for mailing. In order to provide a good fit of the letter panel in the envelope the width of the letter panel 2 should be less than the length Le of the envelope panel 3.

Furthermore, the length L1 of the letter panel 2 should be less than the width We of the envelope panel 3, taken between the glue strips 9, so that the letter 2 folded along the centerline 17 will fit snugly inside the envelope.

Figure 5:
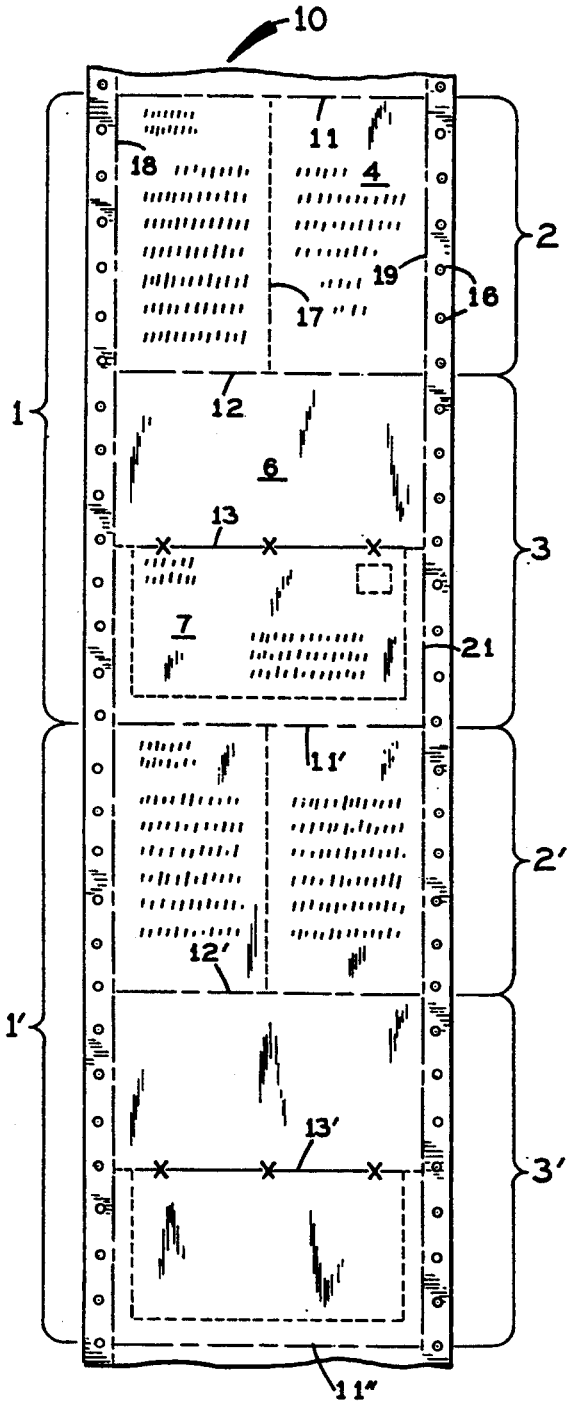
FIG. 5 is a plan view of the invention showing an alternate method of sealing the envelopes.
Figure 6:
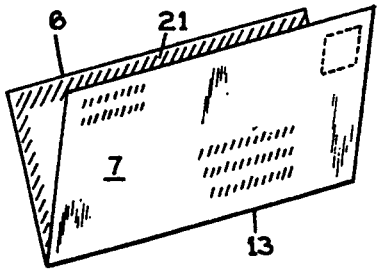
FIG. 6 is a perspective view showing an envelope being sealed according to the alternate method.

Another variation of the sealing arrangement is shown in FIG. 5, wherein no glue flap is used, but instead a glue strip 21 is applied along the three edges of one of the envelope half panels, e.g. half panel 7 on the back side of the paper web 10. The glue strip 21 is shown crosshatched and is applied to the side edges and the edge away from the crease line 13. FIG. 6 shows an envelope 3 with a glue line 21 ready to receive a letter as shown in FIG. 2, and in FIG. 4*a*.

FIG. 7 shows a paper web 10 arranged to have two pages of letter panels 2*a*, 2*b*, which is useful if a two page letter is to be printed, or if a duplicate copy of the original letter is to be retained for file.

In operation the paper web is inserted in a computer printer with sprocket drive. The letter contents can be drawn from a letter file, and the address information can be drawn from an address file as is well known in computer printing. Personalized information can be merged with the letter contents as is also well known. After printing, the letter and envelope panels are separated at the tear-off lines and folded at the crease lines, and the letters are merged with the envelopes. Since corresponding letters and envelopes are printed together, it is easy to keep them together and avoid envelopes being loaded with wrong letters addressed to different persons, as easily happens in other printing systems, wherein letters and envelopes are printed in different processes.

Figure 8A:
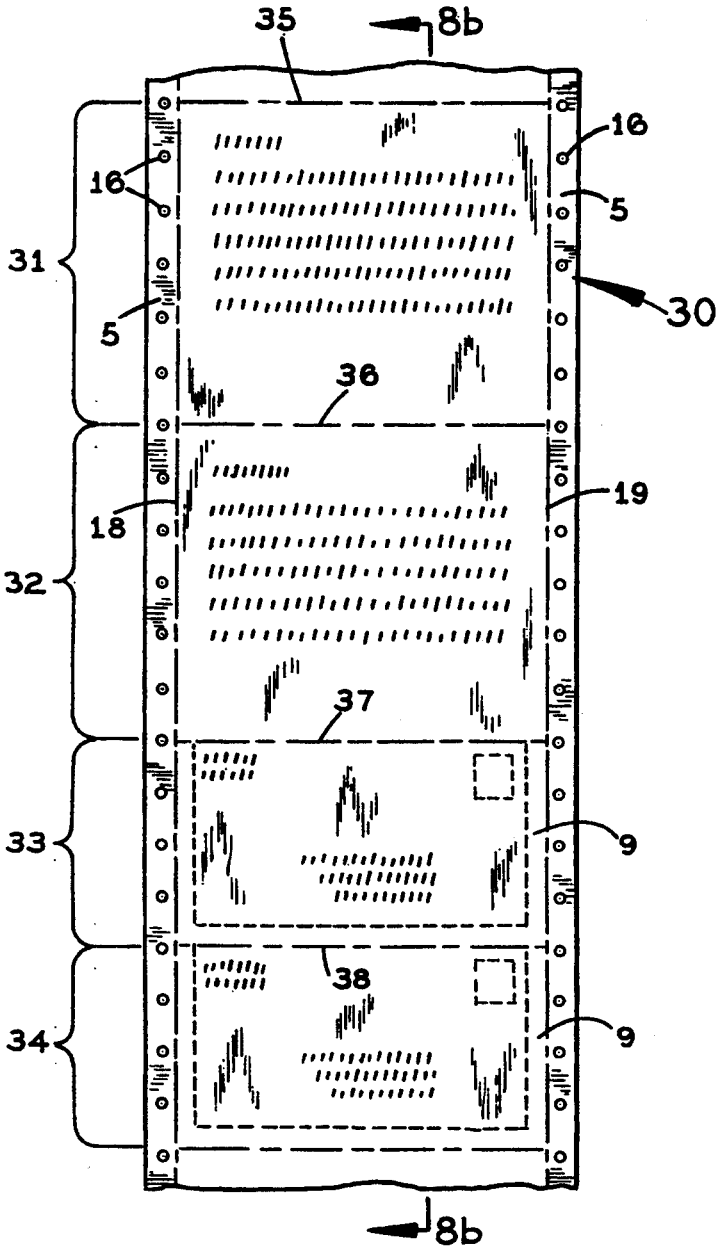
FIG. 8*a* is a plan view of the invention showing a paper web or a section of a paper web with alternating groups of envelopes and letter panels.

In another variation of the invention the envelope section is provided as a ready made envelope, in other words the envelope part is a two-ply section as seen in FIG. 8, details a and b, wherein detail a shows a section of paper web 30 which includes one or two or more letter panels 31, 32 and a folded and partially sealed envelope section 33.

The web 30 again, as described above, can have tear-off edge strips 5 with sprocket holes 16 which can be separated along tear lines 18, 19. Transverse tear lines 34, 36 and 37 allow the letter panels to be separated from the envelope section at tear line 38 after the web has been printed on the forward facing side of the web. The multiple letter panels make it possible to mail, for example, a first copy of a letter to be retained by the recipient and a second letter to be returned to the sender. It follows that similarly a second ready made envelope 34 can be added which may have the sender's return address computer printed thereon.

It also follows that the embodiment according to FIG. 8 can be embodied as a continuous web of paper arranged with alternating groups of letter panels and groups of envelopes as required for different applications.

Figure 8B:
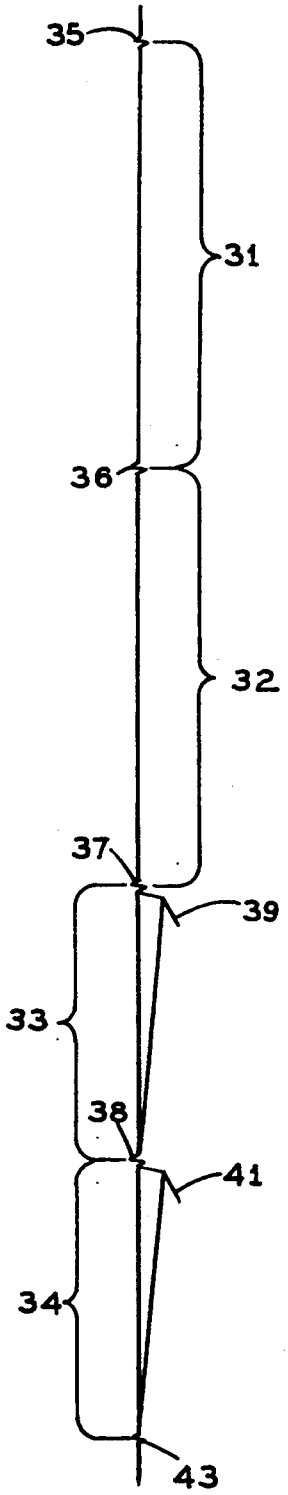
FIG. 8*b* is a side view of the invention according to FIG. 8 showing letter panels and envelopes, seen along the line 8*b*—8*b* of FIG. 8*a*.

The envelopes shown in FIG. 8 are contemplated to be present in the paper web with the three sides of the envelope sealed by a glue strip 9, and with the upward facing side left open, to be sealed with a gummed flap 41, shown in FIG. 8*b*, that is bent over and sealed after the letter panel(s) are inserted.

The paper web can in another embodiment be a web of a limited given length, not having edge strips with sprocket holes, but arranged to be transported in a printer transport with frictional drive with a rubber platen as used in single sheet feeding printers. This arrangement lends itself only for printing short webs, since otherwise the printing will be out of synchronism after printing a certain number of letter and envelope panels. Such a short web can again be divided by transverse tear-lines into one or more letter panels and one or more envelope panels.

The aforesaid web having no sprocket holes is advantageously used in printers that are arranged to print single letter correspondence.

I claim:

1. A continuous envelope and letter arrangement for printing letters and envelope address information on a continuous paper web having a forward side for receiving printing and a back side, comprising lateral edge strips with sprocket holes on the paper web, alternating envelope and letter panels disposed along the paper web, and tear-off lines for separating the envelope and letter panels, disposed transversely between the edge strips, adhesive means on said envelope panels for sealing the envelopes, wherein said envelope and letter panels have identical width between said edge strips in direction transversely to said paper web, wherein said letter panels have a crease line for folding said letter panels about said crease line, and wherein said envelope is adapted for receiving said letter panels before sealing of the envelope; further including lateral tear-off lines on the paper web for separating the edge strips from the paper web; wherein said center crease line is disposed transversely between the edge strips for dividing the envelope panels into two substantially equal size half panels, said half panels respectively forming a front and a back side of said envelope; including on one of said half panels a gummed flap extending away from the respective half panel for sealing the envelope; backward facing gum lines on the back side of said paper web, said backward facing gum lines extending along one transverse edge away from the center crease line of one of said half panels and along its two lateral side edges for sealing said envelope panel; wherein said letter panels have a length L1 taken in direction of said paper web, and said envelope panels have a width We taken transversely to said paper web between said gum lines extending along the lateral side edges, and wherein said width We is greater than said length L1.

2. A continuous envelope and letter arrangement according to claim 1, wherein said letter panels have a width W1 taken between said side strips, and said envelope panels have a length Le taken in direction of said paper web, and wherein said width W1 of the letter panels is less than said length Le of said envelope panels.

3. A continuous envelope and letter arrangement for printing letters and envelope address information on a continuous paper web having a forward side for receiving printing and a back side, comprising lateral edge strips with sprocket holes on the paper web, alternating envelope and letter panels disposed along the paper web, and tear-off lines for separating the envelope and letter panels, disposed transversely between the edge strips, adhesive means on said envelope panels for sealing the envelopes, wherein said envelope and letter panels have identical width between said edge strips in direction transversely to said paper web, wherein said letter panels have a crease line for folding said letter panels about said crease line, and wherein said envelope is adapted for receiving said letter panels before sealing of the envelope; wherein each of said envelope panels is formed as a completed envelope composed of a forward facing envelope panel, and a backward facing back panel attached along three edges to said forward facing envelope panel.

4. A continuous envelope and letter arrangement according to claim 3, including alternating groups of letter panels and completed envelopes.

5. A continuous envelope and letter arrangement according to claim 3, including a gummed flap connected with one of said envelope panels along a fourth edge of the panel.

* * * * *